US006726048B2

(12) United States Patent
Dwinell et al.

(10) Patent No.: US 6,726,048 B2
(45) Date of Patent: Apr. 27, 2004

(54) DRUM PLUG AND SEAL

(75) Inventors: Davis B. Dwinell, Carol Stream, IL (US); Cornelis R. Van De Klippe, West, IL (US)

(73) Assignee: American Flange & Mfg. Co., Inc, Carol Stream IL ( * ) Notice: Subject to any disclaimer, the term of this patent is extended or adjusted under 35 U.S.C. 154(b) by 0 days.

(21) Appl. No.: 10/236,188

(22) Filed: Sep. 9, 2002

(65) Prior Publication Data

US 2004/0045965 A1 Mar. 11, 2004

(51) Int. Cl.[7] ..... B65D 51/20; B65D 53/00; B65D 43/18; B65D 41/16; B65D 17/34

(52) U.S. Cl. ..... 220/257.2; 220/212; 220/214; 220/233; 220/259.3; 220/284; 220/788; 220/304; 220/269; 220/363

(58) Field of Search ..... 220/257.2, 259.3, 220/212, 214, 233, 284, 788, 304, 257.1, 269, 270, 780, 256.1, 361, 363, 288; 215/247, 249, 251, 356, 254, 277, 250, 320, 354, 317

(56) References Cited

U.S. PATENT DOCUMENTS 1,771,012 A * 7/1930 Schwartz ..... 220/257.2
2,760,671 A * 8/1956 Parish, Jr. ..... 220/257.2
3,124,267 A 3/1964 Cetrone
3,838,785 A * 10/1974 Lancesseur ..... 215/251
3,987,929 A * 10/1976 Mineo ..... 220/257.1
4,164,304 A 8/1979 Roberson
4,520,942 A * 6/1985 Dwinell ..... 220/257.2
5,361,921 A * 11/1994 Burns ..... 215/320
5,810,190 A * 9/1998 Welch ..... 220/257.1
5,862,936 A * 1/1999 Johanson ..... 220/304
5,971,189 A * 10/1999 Baughman ..... 220/288
5,996,833 A * 12/1999 Lencioni et al. ..... 220/257.2
6,065,627 A * 5/2000 Johanson ..... 220/304
6,360,908 B1 3/2002 Kline

FOREIGN PATENT DOCUMENTS

DE 3637644 A * 5/1988 ..... B65D/39/08
GB 2222399 A * 3/1990 ..... B65D/51/18

* cited by examiner

*Primary Examiner*—Lee Young
*Assistant Examiner*—James Smalley

(57) ABSTRACT

Closure construction for blow molded drums having an upstanding internally threaded neck. A closure plug with sealing gasket is screwed into the neck to provide a liquid tight seal. A plastic tamper evident overseal completely covers the plug and neck and is manually snapped in place so as to interlockingly engage the plug making both the plug wrench engaging structure and the overseal interlocking structure inaccessible without destruction of the overseal. A tear strip opening means is provided for authorized access.

5 Claims, 3 Drawing Sheets

FIG 1
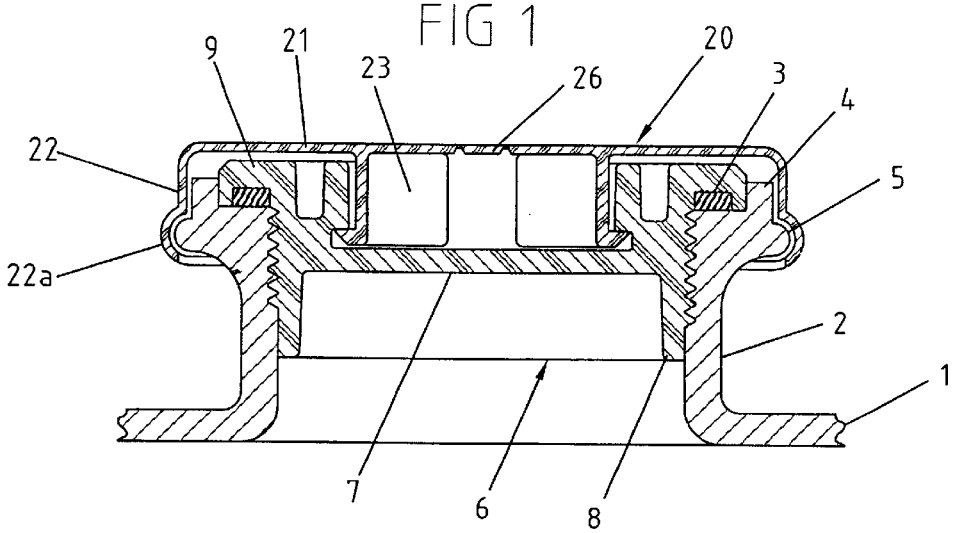
FIG 2
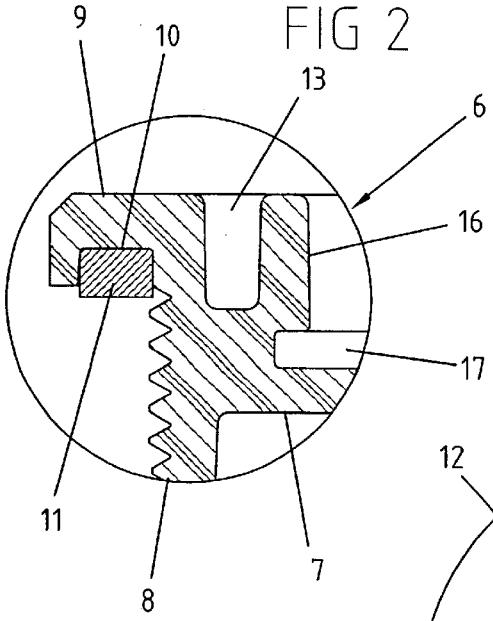
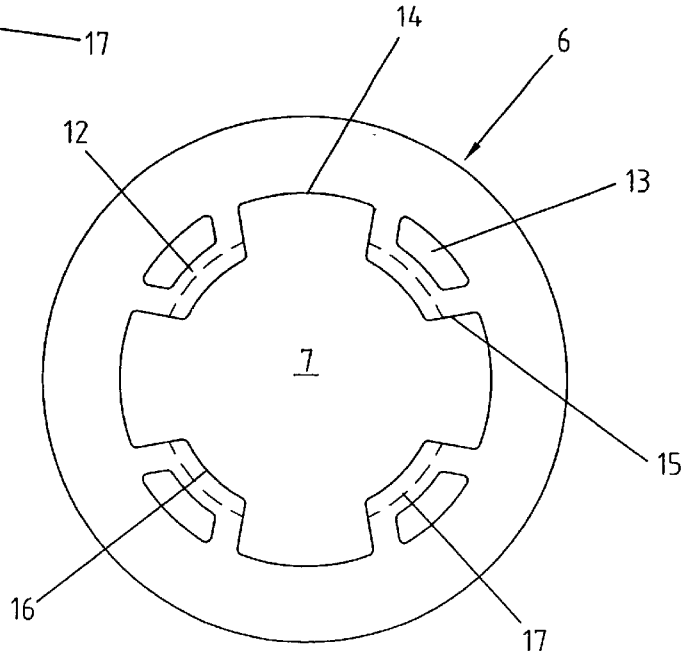
FIG 3

DRUM PLUG AND SEAL

This invention is directed to a threaded plug and tamper evident, hand applied seal for shipping drums.

BACKGROUND OF THE INVENTION

In today's global political climate the security of drummed products is coming under ever closer scrutiny. This, coupled with the need for normal tamper vigilance, is driving a trend toward the increased use of effective tamper indicating seals on all types of shipping containers. It has long been the practice to apply overseals of one kind or another with special hand and power tools which were able to crimp a metal portion of the overseal tightly around an upstanding opening neck designed to receive the seal. These type overseals are rather costly as are tools for their application. Moreover, the application step itself is quite labor intensive and relatively inefficient. Consequently a number of hand applied overseals have come forth which to a certain degree obviate the above mentioned applications tools. These overseals are for the most part easily snapped onto the container opening neck and usually almost as easily snapped off. While these plastic snap-on caps serve to dress up a container such as a 55 gallon drum, giving the closure area a finished appearance and some added degree of cleanliness, there is still much to be desired in terms of drum security. To be effective such drum closure overseals need to meet a number of rather demanding criteria. Obviously the hand application has to be simple and relatively effortless to satisfy normal filling line speeds. Once the drum is shipped, of paramount importance is the ability of the overseal to guard against unauthorized access to the drum contents. This means that the overseal cannot be physically removed without destroying same or making such unauthorized access clearly noticeable and such that the overseal cannot be reapplied in unaltered form to the drum closure. In this regard, those all plastic manually applied overseals currently in general use for both steel and plastic drums are, for the most part, easily pried off in an undetect manner particularly when in a warmed state. In other words "easy on easy off".

Also of importance is the ability of the overseal to resist inadvertent damage during handling and shipment. Commonly employed tamper detection devices such as frangible locking rings, shrink bands and the like found on consumer packages are not at all suited for use on 55 gallon drums. One can easily see that any inadvertent or accidental damage to the tamper resistant overseal immediately raises the question, has the drum security been breached or compromised in some way? Or is this simply damage to be expected resulting from normal handling? This aspect dictates any tamper detecting feature be sufficiently robust to remove any question of doubt as to whether unauthorized entry has in fact occurred.

A performance criteria also of major importance is the ease with which the overseal can be removed from the underlying drum closure in an authorized manner such that subsequent replacement of the overseal is not possible. Normally this requires destruction of the overseal in some fashion to prevent reuse. In this regard the use of sharp cutting or puncturing implements is undesirable due to the likelihood injury or of accidental damage to the underlying closure. Thus, in addition to the overseal's robust construction, hand removeability is yet another advantageous attribute.

SUMMARY OF THE INVENTION

The above described prior art deficiencies are effectively overcome by the advent of the instant invention disclosing a new and improved closure plug and tamper resistant overseal. The plug is formed as a shallow cup having a threaded cylindrical sidewall and a circumferentially enlarged head. Wrench engaging lugs are formed within said sidewall. Interlocking structure is provided on the plug for securement of a hand applied, tamper evident overseal. The overseal is an integrally molded plastic cap which can be manually snapped onto the plug so as to cover the same and the surrounding container neck structure. This construction immediately eliminates the need for any kind of crimping or applying tools and the relative inconvenience attendant thereto. Moreover, going well beyond the prior art all plastic seal arrangements, the invention overseal is so constructed that removal without destroying the seal is virtually impossible. This is accomplished by integrally molding a segmented collet depending axially from a central portion of the plastic cap. Each segment of the collet has a radially enlarged foot and can be spring biased radially. To apply the overseal to an upstanding container neck with the plug screwed in place, the plastic cap is pressed on top of the plug by hand causing the feet on the semented collet to snap into the interlocking structure on the plug. The resulting interengagement is such that unauthorized removal of the overseal is prevented. Unlike other prior art arrangements the relative inaccessibility of the segmented locking collet renders any kind of pry off tool quite useless.

When it comes to removal in an authorized manner the plastic cap is provided with a diametrically extending tear strip defined by a pair of score lines and diametrically opposed gripping ears. Once the tear strip is torn the engagement by the segmented collet is released and the overseal easily removed. However, unlike prior art all plastic seals, the invention overseal is quite obviously destroyed and rendered completely unusable for resealing.

It is accordingly a principal object of the invention to provide a new and improved drum plug and overseal combination.

Another object is to provide an improved threaded drum plug with seal interlocking features.

Still another object is to provide a new and improved tamper evident overseal for drum closures.

Further and more detailed objects will in part be apparent and in part pointed out as the description of the invention taken in conjunction with the accompanying drawing proceeds.

IN THAT DRAWING:

FIG. 1 is a vertical cross sectional view of the closure combination of the invention;

FIG. 2 is an enlarged fragmentary sectional view of the plug wrench engaging lug;

FIG. 3 is a top plan view of the closure plug;

Figure 4:
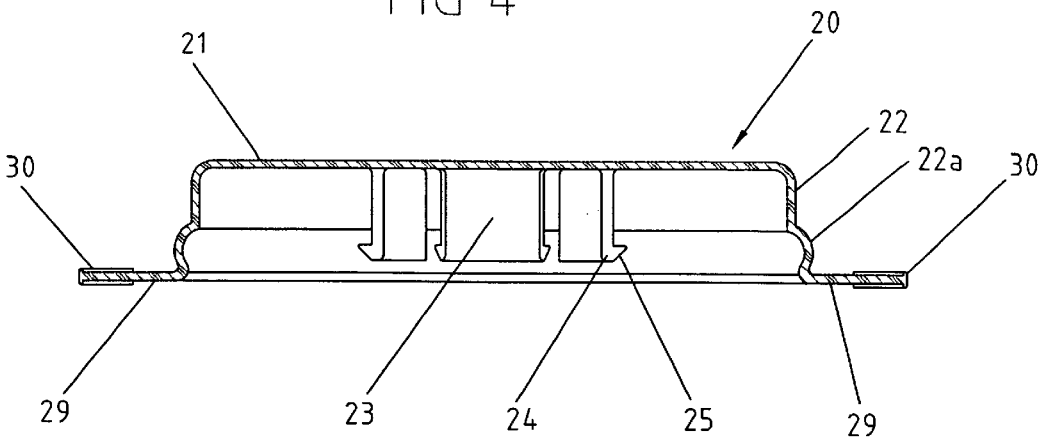
FIG. 4 is a vertical cross sectional view of the closure overseal.
Figure 5:
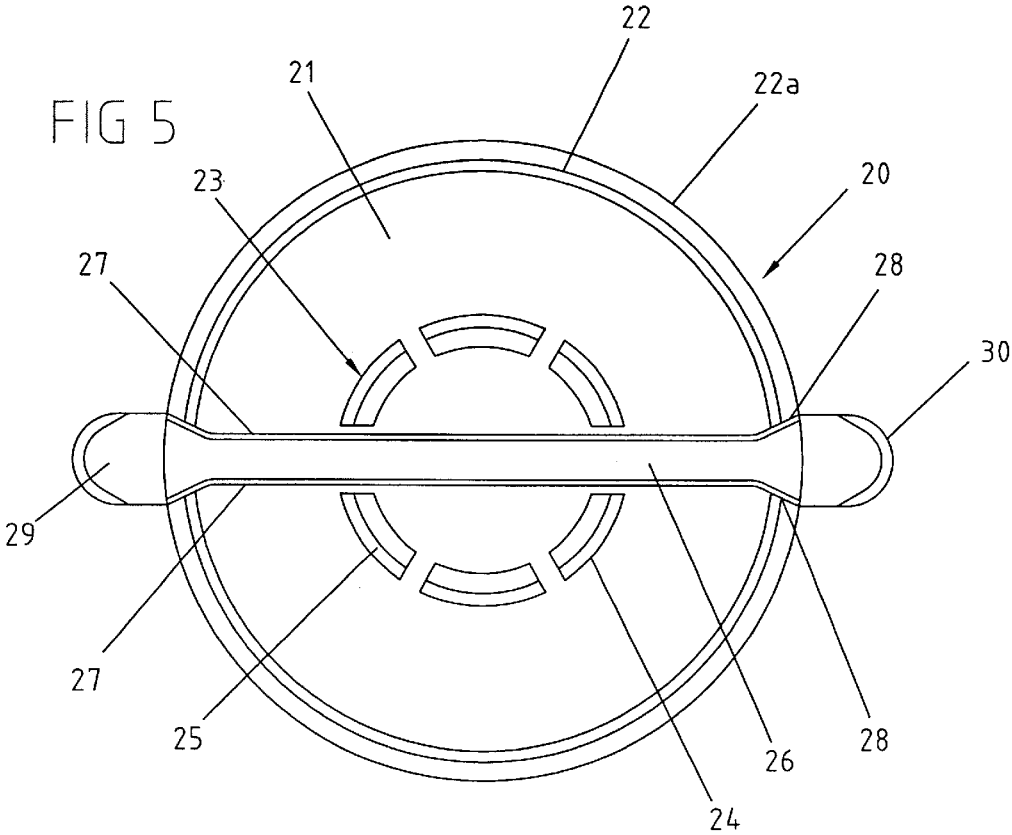
FIG. 5 is a bottom plan view of the overseal shown in FIG. 4.

The closure combination of the invention is shown in FIG. 1 wherein numeral 1 indicates the wall of a container such as an industrial size plastic drum. An upstanding neck 2 defining an internally threaded opening is formed in the container wall. The neck 2 terminates at its upper end in an annular gasket seat 3 surrounded by an upstanding collar 4. Immediately beneath the collar 4 is a peripheral annular bead 5.

A cup shaped closure plug generally indicated at 6 having a bottom wall 7 and an externally threaded sidewall 8 is screwed into the neck 2. The plug has a circumferentially enlarged head 9 with a gasket retaining groove 10 and resilient sealing gasket 11 on the undersurface thereof. Looking at the top surface of the plug in FIG. 3, there are a series of four equally spaced wrench engaging lugs 12 which are hollowed out as indicated at 13. Also, it can be seen that the width of the lugs 12 is slightly less than the width of the gaps 14 therebetween. Each lug has two radially extending wrench engaging surfaces 15 and a radially inwardly facing guide surface 16. At the very bottom of the guide surface 16 where it joins the plug bottom wall 7 there is a locking groove 17 designed to interlockingly engage the closure overseal in a manner described hereinafter.

The closure overseal generally indicated at numeral 20 consists of an imperforate cap molded of synthetic plastic resin having a disc like top wall 21 surrounded by a circumferential depending skirt 22. A segmented collet depends from the central portion of the cap made up of a series of axially elongated leg segments 23 clearly shown in FIG. 4. Each segment terminates at its distal end in a radially outwardly projecting foot 24 having a bottom cam surface 25. A tear strip 26 is formed in the cap defined by a pair of score lines 27 extending diametrically across the top wall 21 so as to intersect the segmented collet shown for purposes of illustration with three of the segments 23 on one side of the tear strip 26 and three segments on the other side of the tear strip. As the score lines 27 approach the cap skirt 22 they diverge outwardly at 28 and continue across the skirt including the circumferentially enlarged portion 22*a* down to the skirt edge. A tearing ear 29 extends outwardly from either end of the tear strip and is provided with a raised outer edge bead 30 to facilitate gripping.

In practice the plug 6 is screwed into the upstanding neck 2 of a shipping container such as a blow molded plastic drum and tightened by a suitable plug wrench designed to exert a force against the wrench engaging surfaces 15 of the lugs 12. Tightening torque applied in this manner causes the gasket 11 to become compressed against the neck gasket seat 3 providing a leak proof liquid seal. The overseal 20 is then placed over the plug with the segmented collet generally axially aligned with the central portion of the plug defined by the wrench engaging lugs. Simply pressing the overseal by hand onto the plug causes the camming surfaces 25 on the segment feet 24 to deflect the segments 23 radially inwardly upon forceful contact with the top of the wrench engaging lugs 12. As the segment feet move axially along the lug guide surfaces 16, the skirt free edge contacts the neck bead 5 causing the skirt enlargement 22*a* to expand thereover. In fully seated position the segment feet 25 snap into the wrench engaging lug grooves 17 expanding back out to their molded position. This interlocking engagement permanently secures the overseal to the plug and, of course, the plug to the container opening since the wrench engaging lugs are rendered inaccessible. In fact, as seen in FIG. 1, the segmented collet itself is inaccessible to any kind of pry off tool making unauthorized removal of the overseal extremely difficult, if not impossible, without destroying the overseal or certainly leaving very clear evidence of tampering. To assure the necessary security the accurate grooves 17 extend laterally and are disposed completely below the plug head top surface and open in an axial plane.

To gain authorized access to the container contents one tearing ear 29 is grasped aided by the raised bead 30 and pulled outwardly separating the tear strip 26 along the score lines 28 and 27 from the rest of the cap. Removal of this top wall section allows the segmented collet to collapse releasing the segment feet 24 from the grooves 17. This release condition occurs when the tearing action reaches the far side 4 of the top wall 21. At this point then, the destroyed and released overseal simply lifts off of the neck 2 still in one piece so that loose cap fragments do not become a problem. Once the overseal is torn off, not only is there assurance against prior opening of the container but in addition the plug and surrounding gasket seat remain dirt free and uncontaminated.

Figure 6:
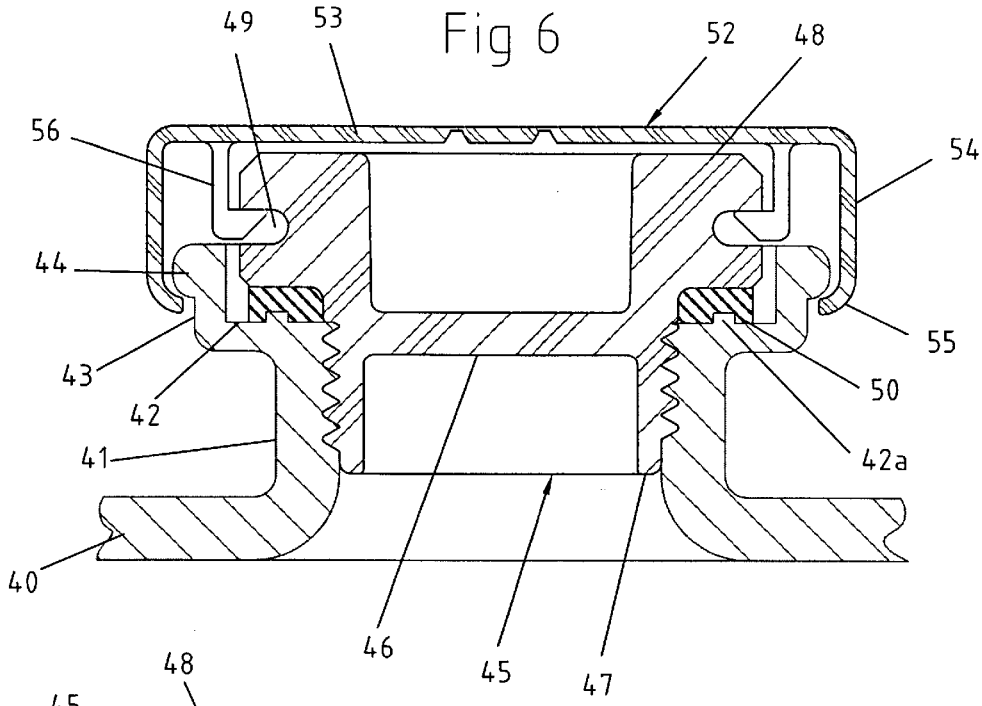
FIG. 6 is a vertical cross sectional view of an alternate form of the closure combination.
Figure 7:
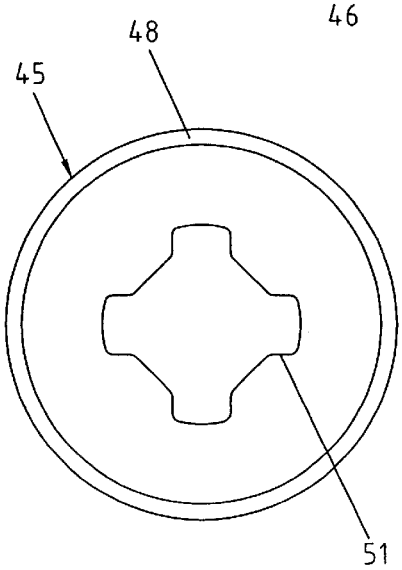
FIG. 7 is a top plan view of the closure plug in FIG. 6.
Figure 8:
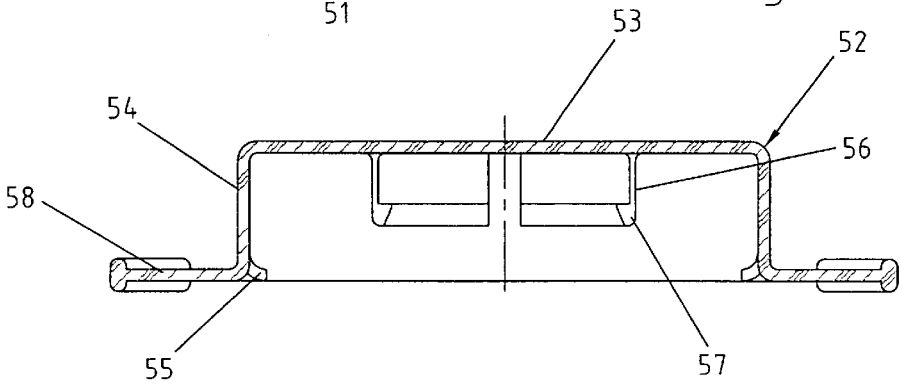
FIG. 8 is a vertical cross sectional view of the closure overseal of FIG. 6.

An alternative form of the invention is shown in FIGS. 6–8 wherein a container 40 has an upstanding internally threaded neck 41 terminating in a gasket seat 42. An annular gasket retaining bead 42*a* is formed on the gasket seat 42 which is surrounded by an annular collar 43 circumferentially enlarged at bead 44. A closure plug generally indicated at 45 having a bottom wall 46 and an externally threaded sidewall 47 is screwed into the neck 41. The plug has a circumferentially enlarged head 48 formed with a radially outwardly opening groove 49 therearound. A sealing gasket 50 is retained on the plug immediately beneath the head 48. As seen in FIG. 7 the plug 46 also has a series of axially extending wrench engaging surfaces 51. A closure overseal 52 has a top wall 53 surrounded by a depending skirt 54 necked inwardly at at its free edge 55. A segmented collet depends from the central portion of the overseal made up of a series of axially elongated segments 56 terminating at their distal ends in radially inwardly projecting feet 57. As in the principal embodiment the seal 52 is formed with a tear strip 53 separating the segments 56 and having radially outwardly extending tearing ears 58.

In this form of the invention the plug 45 is screwed into the neck 41 so as to compress the gasket 50 over the gasket retaining bead 42*a* and bring the groove 49 into horizontal alignment with the top of the neck enlargement 44. The tamper evident overseal 52 is then snapped onto the plug causing the segment feet 57 to expand outwardly and then engage within the groove 49 while at the same time and the inturned skirt edge 55 engages beneath the neck bead 44. Thus as in the principal embodiment, the interlocking structure is inaccessible to unauthorized removal and, of course, the tear strip and tearing ears facilitate removal as intended.

Various other changes in or modifications of the drum closure of the invention would suggest themselves to those skilled in the art and could be made without departing from the spirit or scope of this invention. For example the number spacing of the segments could vary. It is accordingly intended that all matter contained in the above description or shown in the accompanying drawing shall be interpreted as being illustrated and not in a limiting senses.

We claim:

1. A closure plug for shipping containers adapted for cooperative reception of a tamper evident overseal, said plug comprising a cup shaped body having an externally threaded cylindrical sidewall terminating in a circumferentially enlarged head and a head top surface, a gasket seat surrounding said sidewall, a sealing gasket positioned on said gasket seat, axially extending wrench engaging lugs on said plug and a series of individual laterally extending grooves formed in said lugs adapted for interlocking engagement by a tamper evident overseal, said grooves axially disposed in their entirety remote from said plug head at the base of said lugs and opening radially inwardly completely in an axial plane so that said grooves have no exposure to the top surface of said plug.

2. A closure plug as in claim 1 and said lugs are equally spaced on said plug sidewall.

3. A closure plug as in claim 2 and the space between said lugs is greater than the width of said lug inwardly facing surface.

4. The combination of a drum and drum closure comprising an internally threaded threaded drum neck, a closure plug having a cup shaped body threadedly engaged within said drum neck, a sealing gasket interposed said plug and neck, axially extending wrench engaging lugs on said plug, a radial undercut formed in the base of each engaging lug, an imperforate tamper evident overseal overlying said plug and said neck and axially elongated radially deflectable locking means on said overseal interlockingly engaging said radial undercut irrespective of rotational orientation whereby the entire top of the drum neck is protected against contamination and unauthorized access.

5. The combination as in claim 4 and said plug having a circumferentially enlarged head and said sealing gasket seated immediately beneath said head.

* * * * *